US011746641B2

(12) United States Patent
Sheth et al.

(10) Patent No.: US 11,746,641 B2
(45) **Date of Patent: *Sep. 5, 2023**

(54) METHODS TO IMPROVE FLUID FLOW OF A MULTI-PHASE MIXTURE, METHODS TO SEPARATE FLUIDS OF A MULTIPHASE MIXTURE, AND MULTI-PHASE FLUID MIXTURE SYSTEMS

(71) Applicant: Halliburton Energy Services, Inc., Houston, TX (US)

(72) Inventors: Ketankumar Kantilal Sheth, Tulsa, OK (US); Robert Charles De Long, Sand Springs, OK (US); Donn J. Brown, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/489,232

(22) Filed: Sep. 29, 2021

(65) Prior Publication Data

US 2022/0018237 A1 Jan. 20, 2022

Related U.S. Application Data

(62) Division of application No. 16/656,439, filed on Oct. 17, 2019, now Pat. No. 11,162,348.

(51) Int. Cl.
*E21B 43/38* (2006.01)
*E21B 28/00* (2006.01)
(Continued)

(52) U.S. Cl.
CPC ..... *E21B 43/38* (2013.01); *E21B 28/00* (2013.01); *E21B 47/10* (2013.01); *E21B 49/08* (2013.01)

(58) Field of Classification Search
CPC ..... E21B 43/38; E21B 28/00; E21B 47/10; E21B 49/08
See application file for complete search history.

(56) References Cited

U.S. PATENT DOCUMENTS 4,339,247 A 7/1982 Faulkner et al.
H1568 H * 8/1996 Huang ..... 210/708
(Continued)

FOREIGN PATENT DOCUMENTS

WO 2015107014 A1 7/2015

OTHER PUBLICATIONS

Juan G. Osorio, et al.; "Evaluation of resonant acoustic mixing performance"; Powder Technology; Feb. 18, 2015; p. 46-56; vol. 278 (2015); Elsevier B.V.

(Continued)

*Primary Examiner* — D. Andrews
(74) *Attorney, Agent, or Firm* — Barnes & Thornburg, LLP

(57) ABSTRACT

Methods to improve fluid flow of a multi-phase mixture, methods to separate fluids of a multi-phase mixture, and downhole multi-phase fluid mixture systems are disclosed. A method to improve fluid flow of a multi-phase mixture includes positioning a first acoustic device and a second acoustic device around a conveyance that provides a fluid flow path for a first fluid in a first phase and a second fluid in a second phase to simultaneously flow through the conveyance. The method also includes determining a flow rate and a fluid condition of the fluid mixture. The method further includes generating a standing acoustic wave through the conveyance based on the flow rate and the fluid condition to break down the first fluid into droplets having volume within a threshold volume.

20 Claims, 6 Drawing Sheets

(51) Int. Cl.
*E21B 49/08* (2006.01)
*E21B 47/10* (2012.01)

(56) References Cited

U.S. PATENT DOCUMENTS

| | | | | |
|---|---|---|---|---|
| 6,213,208 | B1 | 4/2001 | Skilbeck | |
| 10,246,977 | B2 | 4/2019 | Xiao et al. | |
| 11,162,348 | B2 * | 11/2021 | Sheth | E21B 28/00 |
| 2014/0008307 | A1 | 1/2014 | Guldiken et al. | |
| 2016/0290841 | A1 | 10/2016 | Cadalen et al. | |
| 2017/0175509 | A1 | 6/2017 | Abdel-Fattah et al. | |

OTHER PUBLICATIONS

Hao Feng, et al.; "Ultrasound Technologies for Food and Bioprocessing"; Food Engineering Series; 2011; DOI 10.1007/978-1-4419-7472-3; Springer Science+Business Media, LLC.

Muthupandian Ashokkumar, et al.; "The ultrasonic processing of dairy products—An overview"; HAL archives-ouvertes; HAL Id: hal-00895733; Jan. 1, 2010; https://hal.archives-ouvertes.fr/hal-00895733.

Hossein Hamidi, et al.; "The Effect of Ultrasonic Waves on the Phase Behavior of a Surfactant-Brine-Oil System"; School of Engineering, King's College, University of Aberdeen; 2015; A 482.

Karl S. Hope, et al.; "Resonant Acoustic Mixing: its applications to energetic materials"—presentation; New Trends in Research of Energetic Materials; 2015; Czech Republic.

"Ultrasonic Homogenizers for Liquid Processing"; Hielscher Ultrasound Technology; https://www.hielscher.com/ultrasonic-homogenizers-for-liquid-processing-3.htm; retrieved Oct. 14, 2019.

"Low-Frequency Sonic Mixing Technology"; Offie of Energy Efficiency & Renewable Energy—Department of Energy; https://www.energy.gov/eere/amo/low-frequency-sonic-mixing-technology; retrieved Oct. 14, 2019.

International Search Report and Written Opinion issued in corresponding International Patent Application No. PCT/US2019/057270; dated Jul. 13, 2020.

* cited by examiner

METHODS TO IMPROVE FLUID FLOW OF A MULTI-PHASE MIXTURE, METHODS TO SEPARATE FLUIDS OF A MULTIPHASE MIXTURE, AND MULTI-PHASE FLUID MIXTURE SYSTEMS

BACKGROUND

The present disclosure relates generally to methods to improve fluid flow of a multi-phase mixture, methods to separate fluids of a multi-phase mixture, and multi-phase fluid mixture systems.

Hydrocarbon resources are naturally immiscible with certain carrier fluids, such as water. Some pumps used in downhole artificial lift applications do not efficiently pump unhomogenized mixtures of hydrocarbon and carrier fluid uphole, thereby reducing hydrocarbon output and also increasing wear and tear of the pumps. Gas and fluid separators are sometimes used to separate hydrocarbon resources in liquid and gaseous phases from carrier fluids and other types of fluids. However, gas and fluid separators are sometimes costly, not reliable, and are difficult to deploy, incorporate to pumps, and service.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

Figure 1A:
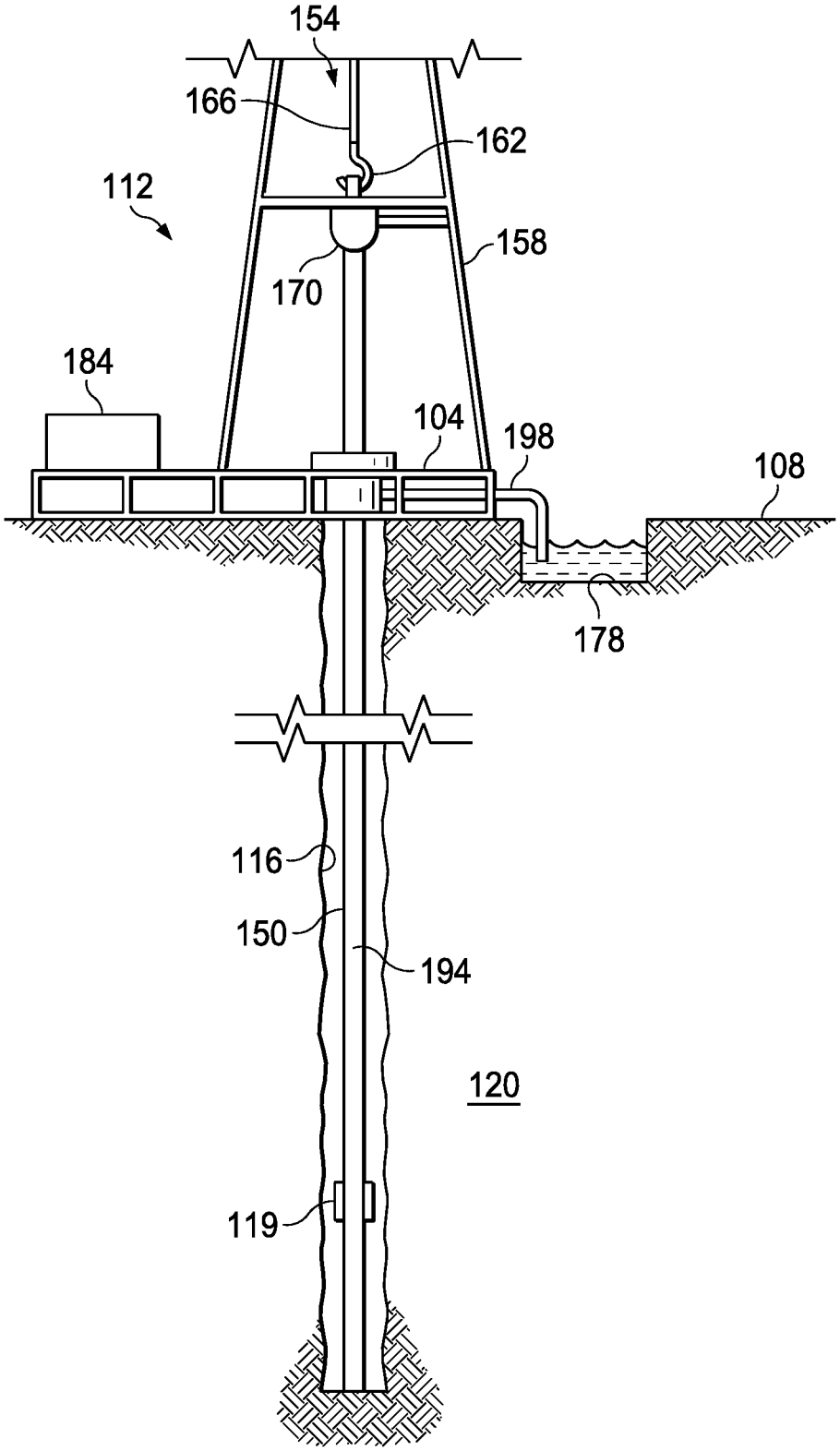
FIG. 1A illustrates a schematic view of an on-shore well having a multi-phase fluid mixture system deployed in the well.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to methods to improve fluid flow of a multi-phase mixture, methods to separate fluids of a multi-phase mixture, and downhole multi-phase fluid mixture systems. A downhole multi-phase fluid mixture system includes one or more acoustic devices that are positioned near a conveyance to generate one or more standing acoustic waves through the conveyance. As referred to herein, an acoustic device is any device operable to generate acoustic waves. Examples of acoustic devices include, but are not limited to, acoustic transducers, acoustic reflectors, acoustic amplifiers, acoustic transmitters, acoustic receivers, acoustic transceivers, as well as other types of mechanical, electrical, or electromechanical devices or components that are operable to transmit sinusoidal waves. Further, as referred to herein, a conveyance may be a production tubing, drill string, drill pipe, coiled tubing, or another type of tubular deployable downhole and having an inner diameter that provides fluid passage for single and multi-phased fluids to flow uphole. As referred to herein, a multi-phase mixture refers to mixtures of two or more phases, such as, but not limited to, a mixture of oil and water (two-phased mixture), a mixture of oil and a carrier fluid (two-phased mixture), a mixture of oil and gas (two-phased mixture), a mixture of different types of oil (two-phased mixture), a mixture of different types of gas (two-phased mixture), a mixture of oil, water, and a gas (three-phased mixture), a mixture of oil, carrier fluid, and a gas (three-phased mixture), as well as other combinations of liquid/liquid mixtures, liquid/gas mixtures, liquid/gas/gas mixtures, or liquid/liquid/gas mixtures. In some embodiments, the mixture is a heterogeneous mixture. In some embodiments, the mixture is a homogeneous mixture. The downhole multi-phase fluid mixture system may include one or more sensors configured to measure the flow rate and fluid conditions of fluids traveling through the conveyance. As referred to herein, fluid conditions of a fluid or a mixture of fluids include, but are not limited to, a density of a fluid, a ratio of a first fluid of a fluid mixture to a second fluid of the fluid mixture, a density of a fluid, a density of the fluid mixture, as well as other fluid properties of fluids or fluid mixtures.

Figure 2A:
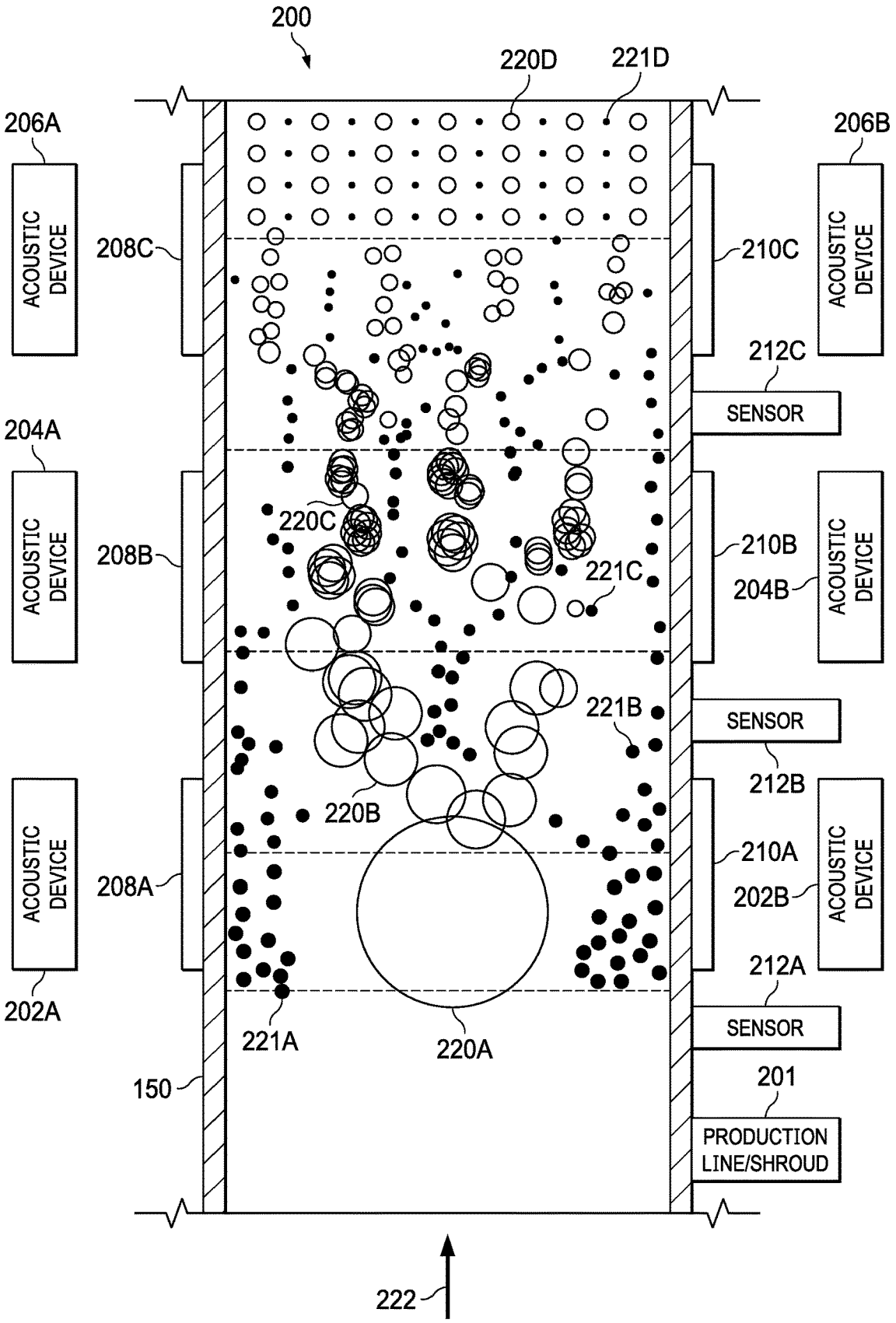
FIG. 2A is a schematic view of a multi-phase fluid mixture system deployed around a conveyance of FIG. 1A and configured to generate acoustic waves to form a fluid mixture.

As fluids flow through the conveyance, the acoustic devices of the downhole multi-phase fluid mixture system generate waveforms having identical wavelengths and amplitudes that combine to form a standing acoustic wave. FIG. 2A, for example, illustrates operating a transducer and a reflector to generate acoustic waves that form a standing acoustic wave illustrated in FIG. 3. In some embodiments, the downhole multi-phase fluid mixture system also includes acoustic amplifiers that are configured to amplify the generated acoustic waves, thereby forming a standing acoustic wave that generates greater time-averaged pressure on fluids flowing through the conveyance. The acoustic devices generate and vary acoustic waves based on the flow rate and the fluid condition of the fluids. In one or more of such embodiments, acoustic waves having a higher number of nodes and anti-nodes are generated in response to a faster fluid flow rate, and acoustic waves having a lower number of nodes and anti-nodes are generated in response to a slower fluid flow rate. Additional descriptions of different configurations of the acoustic devices are provided in the paragraphs below and are illustrated in at least FIGS. 2A-2B.

The standing acoustic wave has an x number of pressure nodes and a y number of pressure anti-nodes spread across the width of the conveyance, where the amplitude of the standing acoustic wave at each node is zero and wherein the amplitude at each anti-node reaches a maximum value. Further, each pressure node is separated from an adjacent pressure anti-node by ¼ of the wavelength of the standing acoustic wave. The alternating pressure nodes and pressure anti-nodes, which are separated by a distance of ¼ of a wavelength, generate alternating spatial acoustic pressure gradients that result in a time-averaged primary acoustic direct force exerted on the fluids, thereby dispersing particles of fluids to pressure nodal planes or pressure anti-nodal planes. As referred to herein, particles of fluids include liquid droplets and gas bubbles.

In some embodiments, as fluids having different densities flow through the conveyance, particles of the less dense fluid are dispersed by the standing acoustic wave towards a pressure nodal plane, and droplets of the less dense fluid are formed along the pressure nodal plane. Further, particles of the more dense fluid are dispersed by the standing acoustic wave towards a pressure anti-nodal plane, and droplets of the more dense fluid are formed along the pressure anti-nodal plane. As referred to herein, a pressure nodal plane is a plane that is axial to the conveyance, perpendicular to the directions of the acoustic waves that form the standing acoustic wave, and bisects a pressure node. Further, and as referred to herein, a pressure anti-nodal plane is a plane that is axial to the conveyance, perpendicular to the directions of the acoustic waves that form the standing acoustic wave, and bisects a pressure anti-node. For example, where oil and water are flowing through the conveyance, the standing acoustic wave disperses oil droplets toward one of one or more pressure nodal planes and disperses water droplets toward one of one or more pressure anti-nodal planes.

As fluids flow through the standing acoustic wave, the standing acoustic wave also exerts secondary acoustic radiation forces on the fluids, thereby separating the fluids into droplets. For example, the secondary acoustic radiation forces of the standing acoustic wave separates oil into oil droplets having volumes within a threshold volume (e.g., 1 cubic millimeter, 1 cubic centimeter, or another volume). In some embodiments, multiple acoustic devices are positioned along the conveyance to further separate fluids (and droplets of fluids) flowing through the conveyance into smaller droplets. Continuing with the foregoing example, a second set of acoustic devices positioned further uphole generates a second standing acoustic wave. The second standing acoustic wave also generates secondary acoustic radiation forces that further separates oil and oil droplets into smaller oil droplets having volumes within a second threshold volume (e.g., ½ cubic millimeter, ½ cubic centimeter, or another volume that is smaller than the first threshold volume). In one or more of such embodiments, a second set of acoustic devices are positioned further uphole from a set of acoustic devices that generate waves that form the first standing acoustic wave. The second set of acoustic devices are configured to generate acoustic waves that form a second standing acoustic wave, where the wavelength of the second standing acoustic wave is shorter than the wavelength of the first standing acoustic wave. Assuming the circumference of the conveyance does not substantially change, the second standing acoustic wave has a greater number of pressure nodes and pressure anti-nodes. Further, the second standing acoustic wave disperses the first and second fluids and droplets of the first and second fluids towards a nodal or anti-nodal plane that bisects a pressure node or a pressure anti-node of the second standing acoustic wave, thereby further separating the first and second fluids and droplets of the first and second fluids into smaller droplets. In one or more of such embodiments, the smaller droplets have volumes within a second threshold volume (e.g., 0.5 cubic millimeter, 0.5 cubic centimeter, or another volume).

In some embodiments, additional sets of acoustic devices are placed further uphole to continuously separate the fluids into smaller droplets of the respective fluids until a homogenized mixture of the fluids is formed. In some embodiments, the downhole fluid mixture system is reconfigured to separate a mixture of fluids into separate fluids (e.g., oil and water). In one or more of such embodiments, where the downhole fluid mixture system has multiple sets of acoustic devices positioned around the conveyance, each set of acoustic devices is configured to generate a standing acoustic wave that has fewer pressure nodes and pressure anti-nodes within the conveyance than an adjacent set of acoustic devices that are further downhole from the respective set of acoustic devices. In this configuration, the primary and secondary forces exerted on particles of the fluids of a mixture gradually decrease, thereby causing the mixture to separate into two fluids. In one or more of such embodiments, the polarity of the acoustic waves generated by the downhole fluid mixture system is reversed to separate the mixture of fluids into separate fluids. For example, where multiple pairs of transducers are arranged in a serial pattern around a conveyance, configuring each successive pair to generate acoustic waves having a shorter wavelength than the preceding pair of transducers in the direction of flow would mix two fluids, whereas reversing the foregoing operation by increasing the wavelengths of acoustic waves generated by each successive pair of transducers in the direction of flow would separate the mixture in two fluids. Additional descriptions of methods to improve fluid flow of a multi-phase mixture, methods to separate fluids of a multi-phase mixture, and downhole multi-phase fluid mixture systems are provided in the paragraphs below.

Figure 1B:
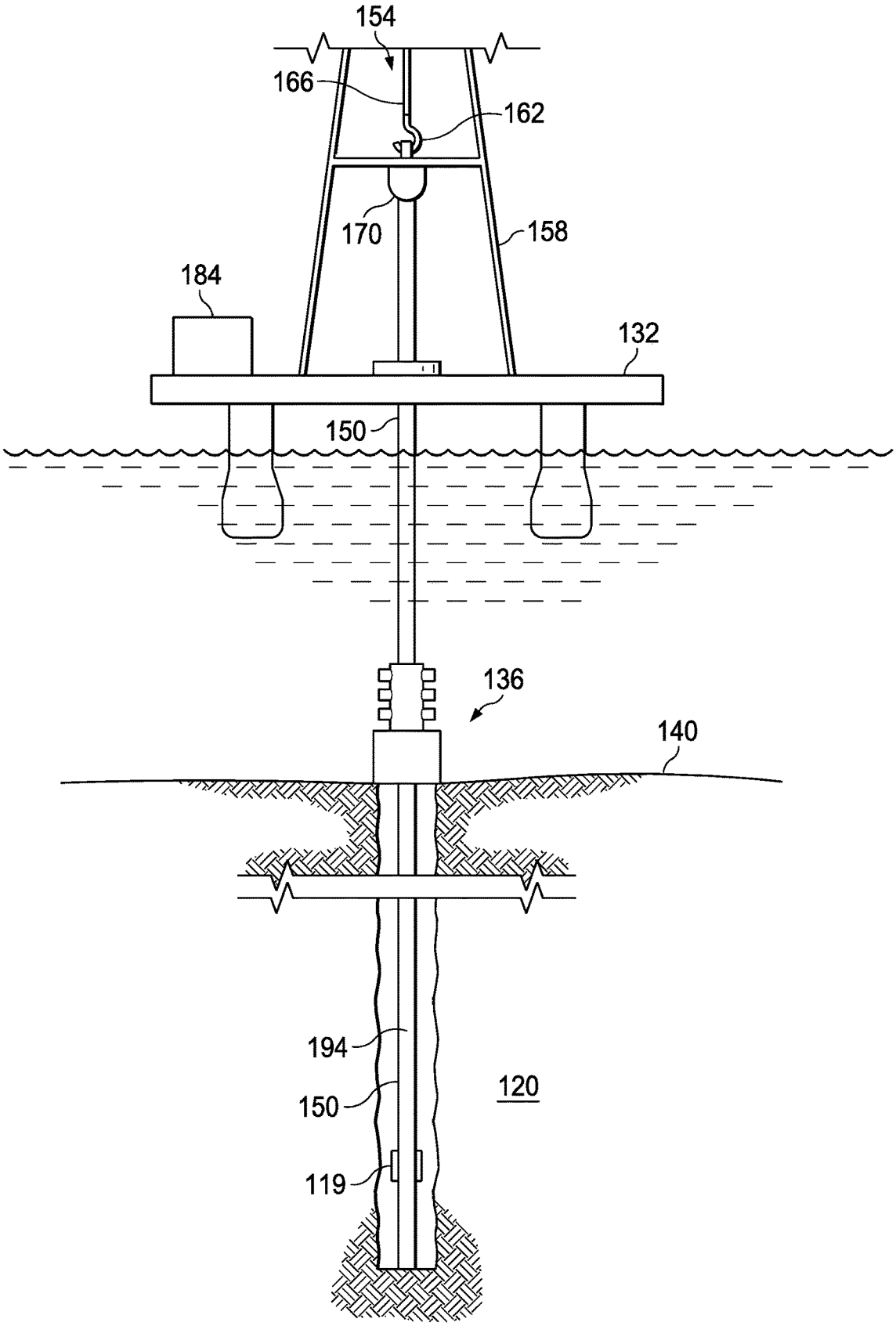
FIG. 1B illustrates a schematic view of an off-shore platform having a multi-phase fluid mixture system deployed in the well.

Turning now to the figures, FIG. 1A illustrates a schematic view of an on-shore well 112 having a downhole multi-phase fluid mixture system 119 deployed in well 112. Well 112 includes wellbore 116 that extends from surface 108 of well 112 to a subterranean substrate or formation 120. Well 112 and rig 104 are illustrated onshore in FIG. 1A. Alternatively, FIG. 1B illustrates a schematic view of an offshore platform 132 having a downhole multi-phase fluid mixture system 119 according to an illustrative embodiment. Downhole multi-phase fluid mixture system 119 in FIG. 1B is deployed in a sub-sea well 136 accessed by the offshore platform 132. In some embodiments, offshore platform 132 is a floating platform. In some embodiments, offshore platform 132 is anchored to a seabed 140.

In the embodiments illustrated in FIGS. 1A and 1B, wellbore 116 has been formed by a drilling process in which dirt, rock and other subterranean material is removed to create wellbore 116. In some embodiments, a portion of wellbore 116 is cased with a casing (not illustrated). In other embodiments, wellbore 116 is maintained in an open-hole configuration without casing. The embodiments described herein are applicable to either cased or open-hole configurations of wellbore 116, or a combination of cased and open-hole configurations in a particular wellbore.

After drilling of wellbore 116 is complete and the associated drill bit and drill string are "tripped" from wellbore 116, a conveyance 150, which in some embodiments eventually functions as a production string, is lowered into wellbore 116. In some embodiments, conveyance 150 includes an interior 194 disposed longitudinally in conveyance 150 that provides fluid communication between the surface 108 of well 112 of FIG. 1A and a downhole location in the formation 120.

In the embodiments of FIGS. 1A and 1B, conveyance 150 is lowered by a lift assembly 154 associated with a derrick 158 positioned on or adjacent to the rig 104 as shown in FIG. 1A or offshore platform 132 as shown in FIG. 1B. The lift assembly 154 includes a hook 162, a cable 166, a traveling block (not shown), and a hoist (not shown) that cooperatively work together to lift or lower a swivel 170 that is coupled to an upper end of conveyance 150. In some embodiments, conveyance 150 is raised or lowered as needed to add additional sections of tubing to conveyance 150 to position downhole multi-phase fluid mixture system 119 at the downhole location in wellbore 116. During production, hydrocarbon resources, such as oil, flow through formation 120 into interior 194. A pump (not shown) is fluidly coupled to conveyance 150 to facilitate flow of oil and other fluids uphole, through an outlet conduit 198, and into a container 178 of FIG. 1A.

In one or more embodiments, conveyance 150 also transmits signals to downhole multi-phase fluid mixture system 119, and other tools and components deployed in wellbore 116. In one or more embodiments, conveyance 150 also provides power to downhole multi-phase fluid mixture system 119, and other tools and components deployed in wellbore 116. In one or more embodiments, conveyance 150 also provides downhole telemetry. In one or more embodiments, conveyance 150 also provides a combination of power and downhole telemetry to downhole multi-phase fluid mixture system 119.

Downhole multi-phase fluid mixture system 119 includes acoustic devices that are coupled to conveyance 150 and configured to generate one or more standing acoustic waves that separate fluids flowing through conveyance 150 into smaller droplets. In some embodiments, downhole multi-phase fluid mixture system 119 deploys multiple sets of acoustic devices to generate multiple standing acoustic waves to further break down fluids flowing through the conveyance until the fluids form a homogenized mixture. In some embodiments, downhole multi-phase fluid mixture system 119 includes sensors (shown in FIG. 2A) that determine a flow rate of fluids flowing through conveyance 150. In one or more of such embodiments, downhole multi-phase fluid mixture system 119 determines characteristics of the standing acoustic wave including, but not limited to, the number of pressure nodes, the number of pressure antinodes, the wavelength, the amplitude, as well as other characteristics of the standing acoustic wave based on the flow rate and the fluid condition of the fluids.

Figure 2B:
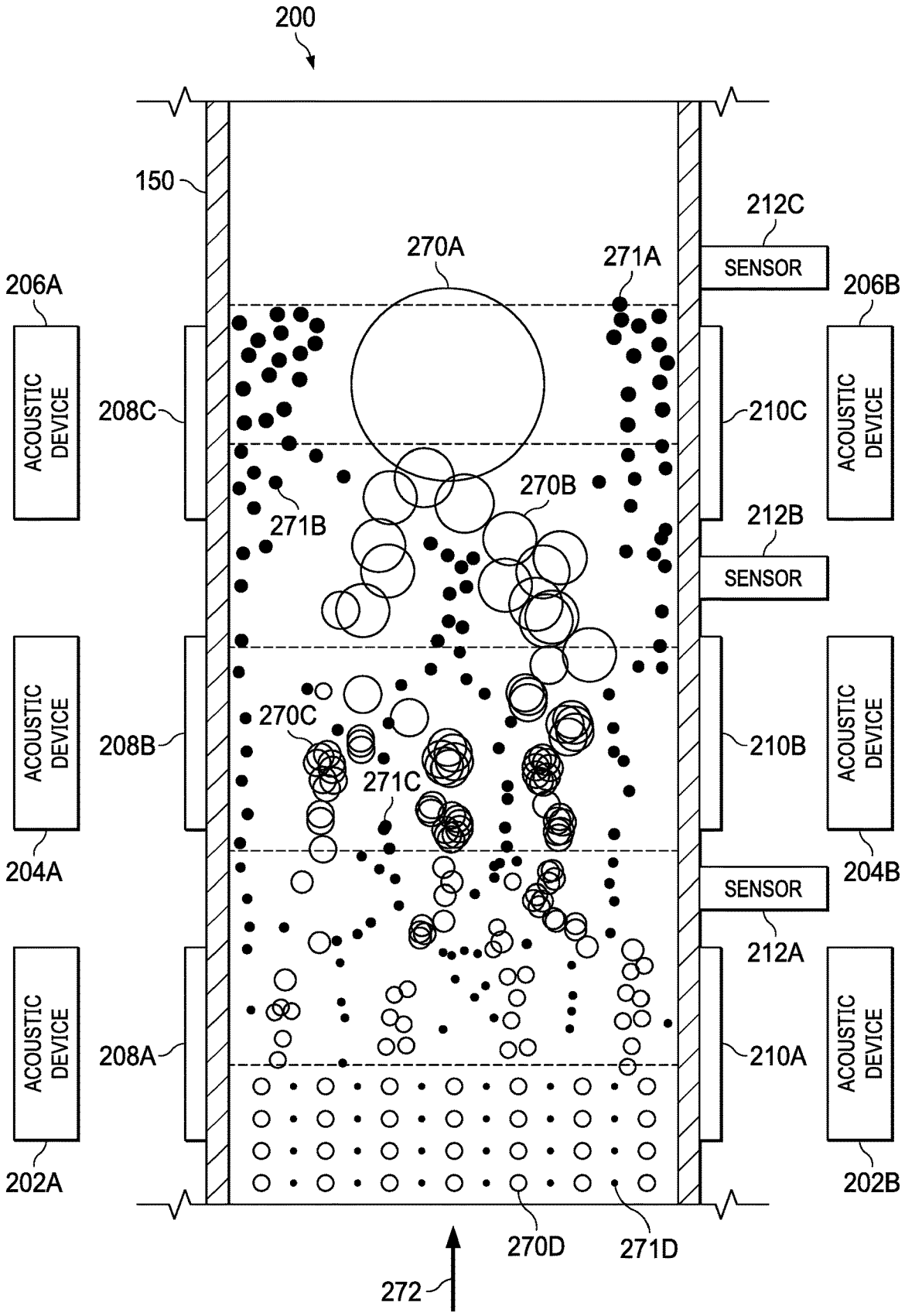
FIG. 2B is a schematic view of the multi-phase fluid mixture system of FIG. 2A reconfigured to generate acoustic waves to separate fluids of a fluid mixture.

In some embodiments, downhole multi-phase fluid mixture system 119 has a surface-based controller 184 that is configured to determine the desired characteristics of a standing acoustic wave based on the flow rate and the fluid condition of the fluids. In one or more of such embodiments, downhole multi-phase fluid mixture system 119 is communicatively connected to controller 184 via a telemetry system described herein and is operable to transmit data associated with the flow rate of the fluids to controller 184. In some embodiments, an operator accesses controller 184 to analyze such data and designates one or more desired characteristics of the standing acoustic wave. In some embodiments, controller 184 dynamically determines the desired characteristics of the standing acoustic wave based on the fluid flow of fluids flowing through conveyance 150. In one or more of such embodiments, controller 184 determines changes in fluid flow of the fluids, dynamically determines new characteristics (e.g., a different amplitude, frequency, or another characteristic) of the standing acoustic wave, and requests the acoustic devices to generate waves that form standing acoustic waves having the newly-determined characteristics. As defined herein, controller 184 represents any electronic device operable to transmit and receive data to determine one or more desirable characteristics of a standing acoustic wave based on a flow rate of fluids flowing through conveyance 150. Additional descriptions of components and configurations of downhole multi-phase fluid mixture system 119 are provided in the paragraphs below and are illustrated in FIGS. 2A-2B.

Although the above paragraphs describe deploying downhole multi-phase fluid mixture system 119 in production environments, downhole multi-phase fluid mixture system 119 is deployable in various other environments where downhole multi-phase fluid mixture system 119 is deployable to improve fluid flow of a multi-phase mixture or separate fluids of a multi-phase mixture. Further, although FIGS. 1A and 1B illustrate a single downhole multi-phase fluid mixture system 119, multiple downhole multi-phase fluid mixture systems are deployable in well 112. Further, although FIGS. 1A and 1B illustrate a surface-based controller 184, in some embodiments, the controller is a downhole component or device, or is deployed at one or more remote locations. Further, although FIGS. 1A and 1B illustrate open-hole production configurations, downhole multi-phase fluid mixture system 119 described herein is also deployable in cased-hole production configurations.

Figure 3:
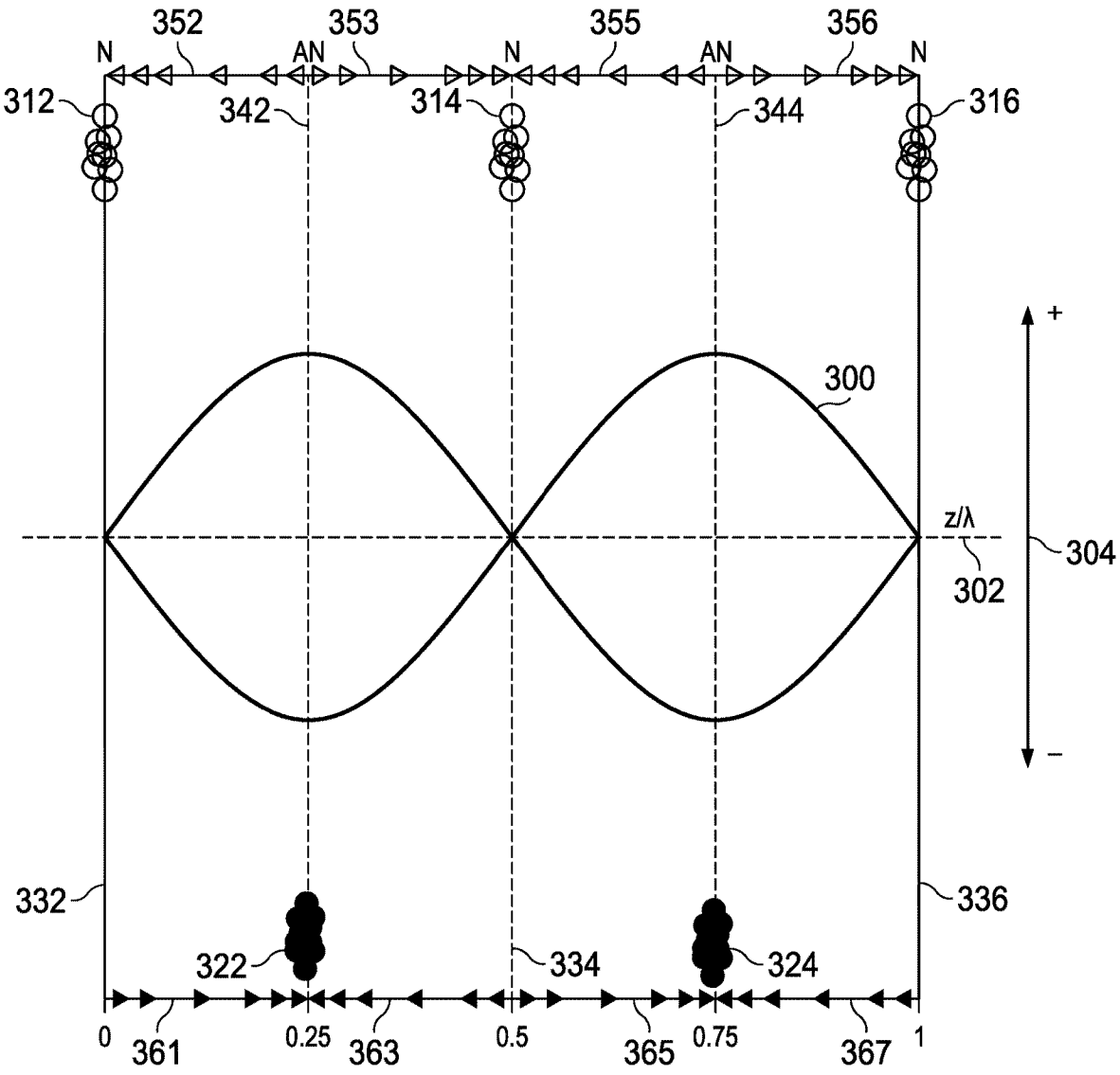
FIG. 3 is a graphical illustration of particles of two fluids dispersed to pressure nodal planes and pressure anti-nodal planes by a standing acoustic wave generated by acoustic devices of the downhole multi-phase fluid mixture system of FIG. 2A.

FIG. 2A is a schematic view of a downhole multi-phase fluid mixture system 200 deployed around conveyance 150 of FIG. 1A. A first fluid (e.g., oil) initially illustrated as having droplet 220A enters conveyance 150 through production shroud 201 and travels uphole in a direction indicated by arrow 222. A second fluid also flows in conveyance 150 and is illustrated by white areas in the conveyance 150 and bubbles 221A-221D. Downhole multi-phase fluid mixture system 200 includes three sets of acoustic devices 202A-202B, 204A-204B, and 206A-206B deployed around conveyance 150. Each of acoustic devices 202A and 202B generates waves (not shown) having an identical first amplitude and an identical first wavelength towards conveyance 150. The acoustic waves generated by acoustic devices 202A and 202B combine to form a first standing acoustic wave illustrated in FIG. 3. The first standing acoustic wave separates droplet 220A of the first fluid into smaller droplets 220B, and separates bubbles 221A of the second fluid into smaller bubbles 221B. Additional descriptions of how fluids are separated into smaller droplets and bubbles are provided in the paragraphs below and are illustrated in FIG. 3. In the embodiment of FIG. 2A, amplifiers 208A and 210A amplify acoustic signals generated by acoustic devices 202A and 202B to generate a standing acoustic wave having a larger amplitude. Further, sensor 212A detects the flow rate and the fluid condition of the first fluid and the second fluid. In some embodiments, acoustic devices 202A and 202B adjust characteristics of acoustic waves (e.g., the amplitude, the wavelength, the wave shape) generated by the respective acoustic devices based on the flow rate and the fluid condition of the first fluid and the second fluid.

Acoustic devices 204A and 204B are positioned further uphole from acoustic devices 202A and 202B. Further, each of acoustic devices 204A and 204B generate waves (not shown) having an identical second amplitude and an identical second wavelength that is shorter than the first wavelength. The acoustic waves generated by acoustic devices 204A and 204B combine to form a second standing acoustic wave (not shown) having a wavelength that is shorter than the wavelength of the first standing acoustic wave. In some embodiments, the amplitude of the second standing acoustic wave is greater than the amplitude of the first standing acoustic wave. The second standing acoustic wave separates droplets 220B of the first fluid into even smaller droplets 220C. In some embodiments, the second standing acoustic wave also separates bubbles 220B the second fluid into smaller bubbles 220C. In the embodiment of FIG. 2A, amplifiers 208B and 210B amplify acoustic signals generated by acoustic devices 204A and 204B to generate a standing acoustic wave having a larger amplitude. Further, sensor 212B detects the flow rate and fluid condition of droplets 220B of the first fluid and bubbles 221B of the second fluid. In some embodiments, acoustic devices 204A and 204B adjust characteristics of acoustic waves (e.g., the amplitude, the wavelength, the wave shape) generated by the respective acoustic devices based on at least one of the flow rate and the fluid condition of droplets 220B of the first fluid and bubbles 221B of the second fluid.

Further, acoustic devices 206A and 206B are positioned further uphole from acoustic devices 204A and 204B. Further, each of acoustic devices 206A and 206B generate acoustic waves (not shown) having an identical third amplitude and an identical third wavelength that is shorter than the second wavelength. The acoustic waves generated by acoustic devices 206A and 206B combine to form a third standing acoustic wave (not shown) having a wavelength that is shorter than the wavelength of the second standing acoustic wave. The third standing acoustic wave separates droplets 220C of the first fluid and bubbles 221C of the second fluid into even smaller droplets 220D of the first fluid and bubbles 221D of the second fluid, respectively. In the embodiment of FIG. 2A, amplifiers 208C and 210C amplify acoustic signals generated by acoustic devices 206A and 206B to generate a standing acoustic wave having a larger amplitude. Further, sensor 212C detects the flow rate and fluid condition of droplets 220C of the first fluid and bubbles 221C of the second fluid. In some embodiments, acoustic devices 206A and 206B adjust characteristics of acoustic waves (e.g., the amplitude, the wavelength, the wave shape) generated by the respective acoustic devices based on at least one of the flow rate and fluid condition of the first fluid and the second fluid. In some embodiments, the foregoing process is performed until the first fluid and the second fluid form a homogenized mixture. The homogenized mixture is then pumped uphole by a pump (not shown). In some embodiments, additional acoustic devices (not shown) are also deployed along conveyance 150 to separate droplets 220B-220D of the first fluid into even smaller droplets.

In some embodiments, downhole multi-phase fluid mixture system 200 is also utilized to separate fluids of a multi-phase mixture, such as a homogenized mixture of oil and water. In that regard, FIG. 2B is a schematic view of downhole multi-phase fluid mixture system 200 of FIG. 2A reconfigured to generate acoustic waves to separate fluids of a fluid mixture. In the embodiment illustrated in FIG. 2B, a mixture of the first fluid (oil) and a second fluid (e.g., a gas) flows in a direction arrow 272. In the illustration of FIG. 2B, the mixture initially includes evenly distributed droplets 270D of the first fluid and bubbles 271D. Acoustic devices 202A-202B, 204A-204B, and 206A-206B are reconfigured to operate in the opposite configuration as described in FIG. 2A, where each standing acoustic wave generated by a pair of acoustic devices has less pressure nodes and pressure anti-nodes than the number of pressure nodes and pressure anti-nodes of an adjacent standing acoustic wave generated by an adjacent pair of acoustic devices further downhole. In that regard, each standing acoustic wave generated by a pair of acoustic devices has a longer wavelength than the wavelength of an adjacent standing acoustic wave generated by an adjacent pair of acoustic devices further downhole. In this configuration, the second standing acoustic wave generated by acoustic devices 204A-204B has less pressure nodes and pressure anti-nodes than the first standing acoustic wave generated by acoustic devices 202A-202B. As such, the secondary acoustic radiation forces exerted by the second acoustic wave is less than the secondary acoustic radiation forces exerted by the first acoustic wave, thereby allowing droplets 270D of the first fluid to combine and form larger droplets 270C of the first fluid and bubbles 271D to combine and form larger bubbles 271C of the second fluid.

Further, the third standing acoustic wave generated by acoustic devices 206A-206B has less pressure nodes and pressure anti-nodes than the second standing acoustic wave generated by acoustic devices 204A-204B. As such, the secondary acoustic radiation forces exerted by the third acoustic wave is less than the secondary acoustic radiation forces exerted by the second acoustic wave, thereby allowing droplets 270C of the first fluid to combine and form larger droplets 270B of the first fluid and bubbles 271C to combine into larger bubbles 271B of the second fluid. This process continues until droplets 270A and bubbles 271A are formed and the first fluid and the second fluid are separated from each other.

In some embodiments, acoustic amplifiers 208A-208C are configured to amplify standing acoustic waves through conveyance 150. In one or more of such embodiments, acoustic amplifiers 208A-208C modify an amplitude of the standing acoustic waves based on at least one of the flow rate and fluid condition of the first fluid and the second fluid.

Although FIGS. 2A and 2B illustrate droplets of a first fluid and bubbles of a second fluid, in some embodiments, both fluids are liquids or both fluids are gases. Further, although FIGS. 2A and 2B illustrate three sets of acoustic devices, in some embodiments, downhole multi-phase fluid mixture system 200 includes a different set of acoustic devices. Further, each set of acoustic devices is operable to generate wave patterns that combine to form multiple standing acoustic waves. In some embodiments, acoustic devices 202A, 204A, and 206A are transducers and acoustic devices 202B, 204B, and 206B are reflectors. In some embodiments, acoustic devices 202A, 204A, and 206A are acoustic transmitters and acoustic devices 202B, 204B, and 206B are acoustic receivers. In some embodiments, acoustic devices 202A-202B, 204A-204B, and 206A-206B are acoustic transceivers, or a different combination of acoustic devices. In some embodiments, downhole multi-phase fluid mixture system 200 also includes additional sensors operable to measure one or more fluid properties of the mixture and fluids of the mixture, such as, but not limited to, a ratio of the first fluid to the second fluid, density of the first fluid, density of the second fluid, density of the mixture, as well as other types of fluid properties of the mixture or the fluids of the mixture. In some embodiments, downhole multi-phase fluid mixture system 200 also includes one or more pumps, such as, but not limited to, plunger pumps, jet pumps, and other types of artificial lift pumps.

In some embodiments, downhole multi-phase fluid mixture system 200 also includes processors that are operable to determine desired characteristics of a standing acoustic wave based on the flow rate and fluid condition of one or more fluids flowing through conveyance 150. In one or more of such embodiments, the energy of a standing acoustic wave increases as the amplitude of the standing acoustic wave increases. In one or more of such embodiments, the processors are configured to adjust the amplitude of the acoustic waves based on fluid flow rate. More particularly, the processors are configured to increase the amplitude of the acoustic waves in response to determining an increase in fluid flow rate to provide additional energy to separate the fluids and decrease the amplitude of the acoustic waves in response to determining a decrease in fluid flow rate to provide less energy to separate the fluids. In one or more of such embodiments, the processors are configured to vary the amplitude of the standing acoustic waves based on a ratio of one fluid to another fluid of the fluid mixture.

FIG. 3 is a graphical illustration of particles of two fluids dispersed to pressure nodal planes and pressure anti-nodal planes by a standing acoustic wave 300 generated by acoustic devices 202A and 202B of downhole multi-phase fluid mixture system 200 of FIG. 2A. In the embodiment of FIG. 3, axis 302 represents distance measured in the wavelength of standing acoustic wave 300 whereas axis 304 represents the amplitude of standing acoustic wave 300. Further, pressure nodal planes are illustrated by lines 332, 334, and 336, whereas pressure anti-nodal planes are illustrated by lines 342 and 344. As illustrated in FIG. 3, adjacent pressure nodal and anti-nodal planes are ¼ of a wavelength apart from each other. Further, particles 312, 314, and 316 represent particles of a less dense fluid, such as gas bubbles 221A-221D of the second fluid of FIG. 2A, whereas particles 322 and 324 represent particles of a more dense fluid, such as the first fluid of FIG. 2A.

The alternating pressure nodes and pressure anti-nodes, which are separated by a distance of ¼ of a wavelength, generate alternating spatial acoustic pressure gradients that result in a time-averaged primary acoustic direct force exerted on particles 312, 314, and 316 of the less dense fluid, and particles 322 and 324 of the more dense fluid, thereby dispersing particles 312, 314, 316, 322, and 324. As shown in FIG. 3, standing acoustic wave 300 exerts a primary acoustic direct force in a direction illustrated by arrows 352 to disperse particle 312 and other particles of the less dense fluid between distance 0 and ¼ of the wavelength of standing acoustic wave 300 to pressure nodal plane 332, exerts a primary acoustic direct force in a direction illustrated by arrows 353 to disperse particle 314 and other particles of the less dense fluid between distance ¼ and ½ of the wavelength of standing acoustic wave 300 to pressure nodal plane 332, exerts a primary acoustic direct force in a direction illustrated by arrows 355 to particles of the less dense fluid between distance ½ and ¾ of the wavelength of standing acoustic wave 300 to pressure nodal plane 334, and exerts a primary acoustic direct force in a direction illustrated by arrows 356 to disperse particle 316 and other particles of the less dense fluid between distance ¾ and 1 wavelength of standing acoustic wave 300 to pressure nodal plane 336.

Standing acoustic wave 300 also exerts a primary acoustic direct force in opposing directions illustrated by arrows 361 and arrows 363 to disperse particle 322 and other particles of the more dense fluid between distance 0 and ¼ of the wavelength of standing acoustic wave 300 and between ¼ and ½ of the wavelength of standing acoustic wave 300, respectively, to pressure anti-nodal plane 342. Further, standing acoustic wave 300 also exerts a primary acoustic direct force in opposing directions illustrated by arrows 365 and arrows 367 to disperse particle 324 and other particles of the more dense fluid between distance ½ and ¾ of the wavelength of standing acoustic wave 300 and between ¾ and 1 wavelength of standing acoustic wave 300, respectively, to pressure anti-nodal plane 344. Further, standing acoustic wave 300 also exerts secondary acoustic radiation forces on particles of the more dense fluid, including particles 322 and 324 of the more dense fluid, to separate the particles into smaller droplets of the more dense fluid.

Figure 4:
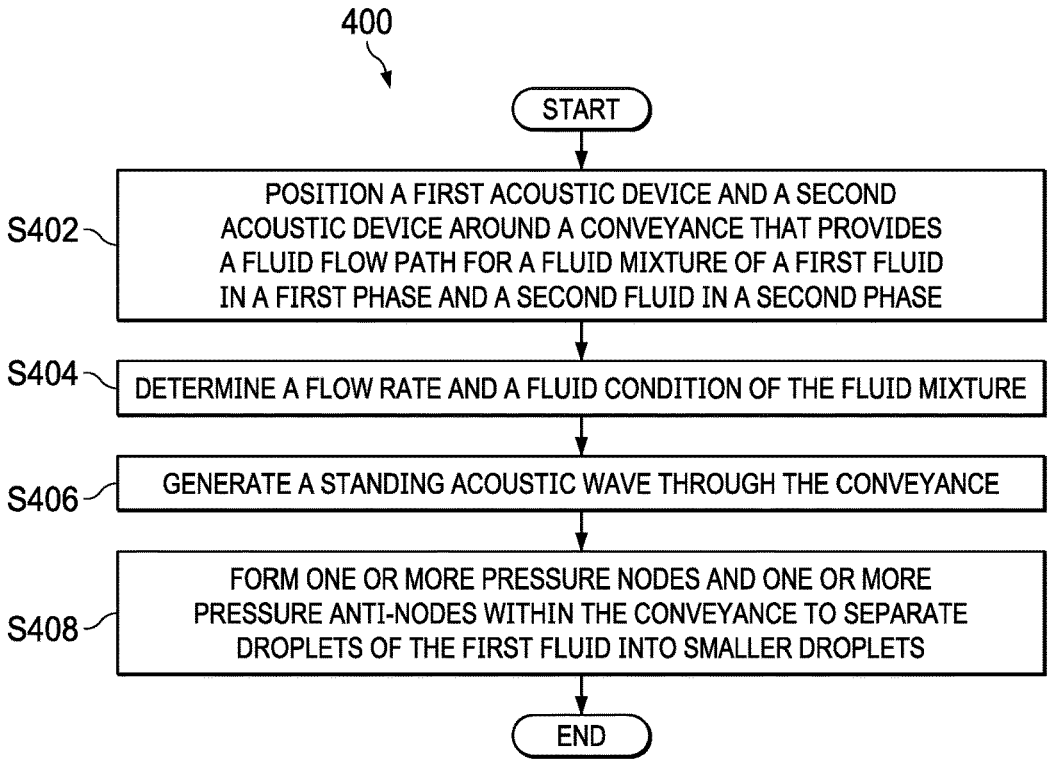
FIG. 4 illustrates a flowchart of a process to improve fluid flow of a multi-phase mixture.

FIG. 4 illustrates a flowchart of a process 400 to improve fluid flow of a multi-phase mixture. Although the operations in process 400 are shown in a particular sequence, certain operations may be performed in different sequences or at the same time where feasible.

At block S402, a first acoustic device and a second acoustic device are positioned around a conveyance that provides a fluid flow path for a fluid mixture of a first fluid in a first phase and a second fluid in a second phase to simultaneously flow through the conveyance. As shown in FIG. 2A, first acoustic device 202A and second acoustic device 202B are positioned around conveyance 150. Further, a fluid mixture of a first fluid having droplets 220A-220D and a second fluid having bubbles 221A-221D flows through conveyance 150. In some embodiments, the first acoustic device is a transducer and the second acoustic device is a reflector. In some embodiments, each of the first and second acoustic devices is a transceiver.

At block S404, a flow rate and a fluid condition of the fluid mixture is determined. As shown in FIG. 2A, sensors 212A-212C are positioned along conveyance 150 and measure the flow rate of the first fluid and the second fluid as first fluid and the second fluid travel along conveyance 150, the densities of the first fluid and the second fluid, and the ratio of the first fluid to the second fluid. In some embodiments, the sensors 212A-212C are configured to determine the flow rate of individual fluids (e.g. the first fluid or the second fluid) of a mixture. In the embodiment of FIGS. 2A and 2B, sensors 212A-212C are positioned around an outer diameter of conveyance 150. In some embodiments, sensors 212A-212C are positioned inside the inner diameter of conveyance 150. In some embodiments, sensors 212A-212C are positioned downhole to the acoustic devices 202A-202B, 204A-204B, and 206A-206B of FIGS. 2A and 2B, respectively. In some embodiments, sensors 212A-212C are positioned uphole to the acoustic devices 202A-202B, 204A-204B, and 206A-206B, respectively. In some embodiments, some of the sensors are positioned downhole to the acoustic devices and some of the sensors are positioned uphold to the acoustic devices. In some embodiments, sensors 212A-212C are configured to transmit data indicative of measurements of the flow rate of the mixture (or individual fluids of the mixture) to processors, such as the processors of controller 184 of FIG. 1.

At block S406, a standing acoustic wave is generated through the conveyance based on the flow rate and the fluid condition of the fluid mixture. In the embodiment of FIGS. 1A and 1B, the processors of controller 184 determine properties of the standing acoustic wave (e.g., the amplitude, frequency, as well as other wave properties of the standing acoustic wave) based on the flow rate of the fluid mixture and the ratio of the first fluid to the second fluid. The processors then request acoustic devices 202A-202B of FIG.

2A to generate standing acoustic waves having the determined wave properties. Acoustic devices 202A and 202B then generate waves that form standing acoustic wave 300 of FIG. 3.

At block S408, one or more pressure nodes and one or more pressure anti-nodes are formed within the conveyance to separate droplets of the first fluid into smaller droplets. Standing acoustic wave 300 exerts a time-averaged primary acoustic direct force on particles of fluids to disperse the fluid particles towards a pressure nodal plane or a pressure anti-nodal plane based on the density of the corresponding fluid. Further, standing acoustic wave 300 also exerts secondary acoustic radiation forces on particles to breakdown the fluid particles into smaller fluid particles. In that regard, FIG. 2A shows the droplet size of droplets 220A-220D of the first fluid progressively shrinking as the first fluid passes between successive sets of acoustic devices. In some embodiments, acoustic amplifiers, such as amplifies 208A-208C of FIG. 2A are configured to amplify the generated standing acoustic waves to further breakdown fluid particles to smaller fluid particles. In one or more of such embodiments, the acoustic amplifiers are configured to vary the amplification of the standing acoustic waves based on the flow rate of the fluid mixture. In one or more of such embodiments, the acoustic amplifies are configured to vary the amplification of the standing acoustic waves based on a ratio of the first fluid to the second fluid.

Figure 5:
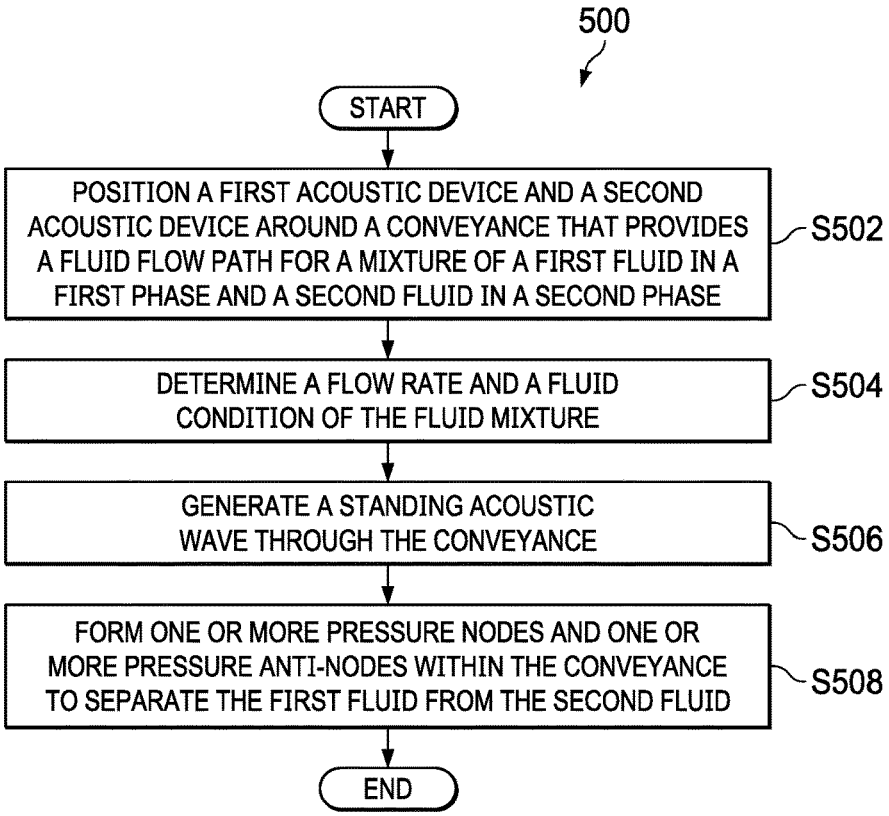
FIG. 5 illustrates a flowchart of a process to separate fluids of a multi-phase mixture.

FIG. 5 is a flowchart of a process 500 to separate fluids of a multi-phase mixture. Although the operations in process 500 are shown in a particular sequence, certain operations may be performed in different sequences or at the same time where feasible.

At block S502, a first acoustic device and a second acoustic device are positioned around a conveyance that provides a fluid flow path for a mixture of a first fluid in a first phase and a second fluid in a second phase to flow within the conveyance. As shown in FIG. 2B, first acoustic device 202A and second acoustic device 202B are positioned around conveyance 150.

At block S504, a flow rate and a fluid condition of the fluid mixture is determined. The operations performed at block S504 are similar to the operations performed at block S404, which are described above. At block S506, a standing acoustic wave is generated through the conveyance based on the flow rate and the fluid condition of the fluid mixture. In the embodiment of FIGS. 1A and 1B, the processors of controller 184 determine properties of the standing acoustic wave (e.g., the amplitude, frequency, as well as other wave properties of the standing acoustic wave) based on the flow rate of the fluid mixture and the ratio of the first fluid to the second fluid. The processors then request acoustic devices 202A-202B of FIG. 2B to generate standing acoustic waves having the determined wave properties. Acoustic devices 202A and 202B then generate waves that form standing acoustic waves similar to standing acoustic wave 300 of FIG. 3.

At block S508, one or more pressure nodes and one or more pressure anti-nodes are formed within the conveyance to separate the first fluid from the second fluid. In the illustrated embodiment of FIG. 2B, a mixture of the first fluid and the carrier fluid flows in a direction indicated by arrow 272. Further acoustic devices 202A and 202B, 204A-204B, and 206A-206B operate in the opposite configuration as described with respect to FIG. 2A, where each standing acoustic wave generated by a pair of acoustic devices has less pressure nodes and pressure anti-nodes than the number of pressure nodes and pressure anti-nodes of an adjacent standing acoustic wave generated by an adjacent pair of acoustic devices further downhole. In this configuration, the primary and secondary forces exerted on particles of the fluids of the mixture gradually decrease, thereby causing droplets 270D-270B of the first fluid to combine to form larger droplets 270C-270A, respectively, and bubbles 271D-271B to combine to form larger bubbles 271C-271A. As shown in FIG. 2B, the mixture of evenly distributed droplets 270D of the first fluid and bubbles 271D of the second fluid gradually separate into two fluids.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a method to improve fluid flow of a multi-phase mixture, the method comprising: positioning a first acoustic device and a second acoustic device around a conveyance that provides a fluid flow path for a fluid mixture of a first fluid in a first phase and a second fluid in a second phase; determining a flow rate and a fluid condition of the fluid mixture; generating a standing acoustic wave through the conveyance based on the flow rate and the fluid condition of the fluid mixture; and forming one or more pressure nodes and one or more pressure anti-nodes within the conveyance to separate droplets of the first fluid into smaller droplets.

Clause 2, the method of clause 1, wherein generating the standing acoustic wave comprises generating the standing acoustic wave through the conveyance to separate the droplets of the first fluid into smaller droplets having volumes within a first threshold volume and to separate droplets of the second fluid into smaller droplets having volumes within a second threshold volume.

Clause 3, the method of clauses 1 or 2, wherein droplets of the first fluid have volumes within a first threshold volume, the method further comprising: positioning a third acoustic device and a fourth acoustic device around the conveyance and further uphole from the first acoustic device and the second acoustic device; and generating a second standing acoustic wave through the conveyance to separate the droplets of the first fluid into droplets having volumes within a second threshold volume, where the second standing acoustic wave has a higher frequency than a frequency of the standing acoustic wave, and wherein the second threshold volume is smaller than the first threshold volume.

Clause 4, the method of clause 3, wherein generating the standing acoustic wave comprises configuring the standing acoustic wave to have a first number of pressure nodes within the conveyance, and wherein generating the second standing acoustic wave comprises configuring the second standing acoustic wave to have a second number of pressure nodes that is greater than the first number of pressure nodes.

Clause 5, the method of clause 4, wherein the second standing acoustic wave has a shorter wavelength than a wavelength of the standing acoustic wave.

Clause 6, the method of any of clauses 1-5, wherein the second fluid is a carrier fluid, wherein the first fluid is less dense than the second fluid, and wherein one or more droplets of the first fluid are dispersed by the standing acoustic wave towards the one or more pressure nodes.

Clause 7, the method of any of clauses 1-5, wherein the second fluid is a carrier fluid, wherein the first fluid is more dense than the second fluid, and wherein one or more droplets of the first fluid are dispersed by the standing acoustic wave towards the one or more pressure anti-nodes.

Clause 8, the method of any of clauses 1-7, further comprising positioning an acoustic amplifier around the conveyance to amplify the standing acoustic wave through the conveyance.

Clause 9, the method of clause 8, further comprising modifying an amplitude of the standing acoustic wave based on the flow rate of the fluid mixture.

Clause 10, the method of clause 8, further comprising modifying an amplitude of the standing acoustic wave based on the flow rate of the fluid mixture and a ratio of the first fluid to the second fluid.

Clause 11, the method of any of clauses 1-10, further comprising forming a homogenized mixture of the first fluid and the second fluid.

Clause 12, a method to separate fluids of a multi-phase mixture, the method comprising: positioning a first acoustic device and a second acoustic device around a conveyance that provides a fluid flow path for a fluid mixture of a first fluid in a first phase and a second fluid in a second phase to flow within the conveyance; determining a flow rate and a fluid condition of the fluid mixture; generating a standing acoustic wave through the conveyance based on the flow rate and the fluid condition of the fluid mixture; and forming one or more pressure nodes and one or more pressure anti-nodes within the conveyance to separate the first fluid from the second fluid.

Clause 13, the method of clause 12, wherein the fluid mixture comprises a plurality of droplets of the first fluid having volumes within a first threshold volume, and wherein generating the standing acoustic wave comprises combining a first plurality of droplets of the first fluid having volumes within a first threshold into a second plurality of droplets of the first fluid having volumes within a second threshold volume that is greater than the first threshold volume.

Clause 14, the method of clause 13, further comprising: positioning a third acoustic device and a fourth acoustic device around the conveyance and further uphole from the first acoustic device and the second acoustic device; and generating a second standing acoustic wave through the conveyance to combine the second plurality of droplets into a third plurality of droplets having volumes within a third threshold volume that is greater than the second threshold volume.

Clause 15, the method of clause 14, wherein generating the standing acoustic wave comprises configuring the standing acoustic wave to have a first number of pressure nodes within the conveyance, and wherein generating the second standing acoustic wave comprises configuring the second standing acoustic wave to have a second number of pressure nodes that is less than the first number of pressure nodes.

Clause 16, the method of clause 15, wherein the second standing acoustic wave has a longer wavelength than a wavelength of the standing acoustic wave.

Clause 17, the method of any of clauses 12-16 wherein the second fluid is a carrier fluid, wherein the first fluid is less dense than the second fluid, and wherein one or more droplets of the first fluid are dispersed by the standing acoustic wave towards the one or more pressure nodes.

Clause 18, the method of any of clauses 12-16, wherein the second fluid is a carrier fluid, wherein the first fluid is more dense than the second fluid, and wherein one or more droplets of the first fluid are dispersed by the standing acoustic wave towards the one or more pressure anti-nodes.

Clause 19, the method of any of clauses 12-18, further comprising positioning an acoustic amplifier around the conveyance to amplify the standing acoustic wave through the conveyance.

Clause 20, the method of clause 19, further comprising modifying an amplitude of the standing acoustic wave based on the flow rate of the fluid mixture.

Clause 21, the method of clause 19, further comprising modifying an amplitude of the standing acoustic wave based on the flow rate of the fluid mixture and a ratio of the first fluid to the second fluid.

Clause 22, the method of any of clauses 12-21, further comprising forming a heterogeneous mixture of the first fluid and the second fluid.

Clause 23, a downhole multi-phase fluid mixture system, comprising: a sensor disposed around a conveyance and configured to measure a flow rate of a first fluid in a first phase and a second fluid in a second phase that simultaneously flow through an inner diameter of the conveyance; and a first acoustic device and a second acoustic device positioned around the conveyance and configured to generate a standing acoustic wave through the conveyance to separate the first fluid into droplets having volumes within a threshold volume.

Clause 24, the downhole multi-phase fluid mixture system of clause 23, further comprising a third acoustic device and a fourth acoustic device positioned around the conveyance uphole from the first acoustic device and the second acoustic device, and configured to generate a second standing acoustic wave through the conveyance to separate the droplets of the first fluid into droplets having volumes within a second threshold volume that is smaller than the threshold volume.

Clause 25, the downhole multi-phase fluid mixture system of clauses 23 or 24, further comprising an acoustic amplifier that is positioned around the conveyance and configured to amplify the standing acoustic wave through the conveyance.

Clause 26, the downhole multi-phase fluid mixture system of any of clauses 23-25, wherein the sensor is mounted in the inner diameter of the conveyance.

Unless otherwise specified, any use of any form of the terms "connect," "engage," "couple," "attach," or any other term describing an interaction between elements in the foregoing disclosure is not meant to limit the interaction to direct interaction between the elements and may also include indirect interaction between the elements described. As used herein, the singular forms "a", "an," and "the" are intended to include the plural forms as well, unless the context clearly indicates otherwise. Unless otherwise indicated, as used throughout this document, "or" does not require mutual exclusivity. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

It should be apparent from the foregoing that embodiments of an invention having significant advantages have been provided. While the embodiments are shown in only a few forms, the embodiments are not limited but are susceptible to various changes and modifications without departing from the spirit thereof

What is claimed:

1. A method to separate fluids of a multi-phase mixture, the method comprising:

positioning a first acoustic device and a second acoustic device around a conveyance that provides a fluid flow path for a fluid mixture of a first fluid in a first phase and a second fluid in a second phase to flow within the conveyance;

determining a flow rate and a fluid condition of the fluid mixture;

generating a standing acoustic wave through the conveyance based on the flow rate and the fluid condition of the fluid mixture;

utilizing an acoustic amplifier disposed around the exterior surface of the conveyance to amplify the standing acoustic wave; and forming one or more pressure nodes and one or more pressure anti-nodes within the conveyance to separate the first fluid from the second fluid.

2. The method of claim 1, wherein the fluid mixture comprises a plurality of droplets of the first fluid having volumes within a first threshold volume, and wherein generating the standing acoustic wave comprises combining a first plurality of droplets of the first fluid having volumes within a first threshold into a second plurality of droplets of the first fluid having volumes within a second threshold volume that is greater than the first threshold volume.

3. The method of claim 2, further comprising:

positioning a third acoustic device and a fourth acoustic device around the conveyance and further uphole from the first acoustic device and the second acoustic device; and generating a second standing acoustic wave through the conveyance to combine the second plurality of droplets into a third plurality of droplets having volumes within a third threshold volume that is greater than the second threshold volume.

4. The method of claim 3, wherein generating the standing acoustic wave comprises configuring the standing acoustic wave to have a first number of pressure nodes within the conveyance, and wherein generating the second standing acoustic wave comprises configuring the second standing acoustic wave to have a second number of pressure nodes that is less than the first number of pressure nodes.

5. The method of claim 4, wherein the second standing acoustic wave has a longer wavelength than a wavelength of the standing acoustic wave.

6. The method of claim 1, wherein the second fluid is a carrier fluid, wherein the first fluid is less dense than the second fluid, and wherein one or more droplets of the first fluid are dispersed by the standing acoustic wave towards the one or more pressure nodes.

7. The method of claim 1, wherein the second fluid is a carrier fluid, wherein the first fluid is more dense than the second fluid, and wherein one or more droplets of the first fluid are dispersed by the standing acoustic wave towards the one or more pressure anti-nodes.

8. The method of claim 1, further comprising modifying an amplitude of the standing acoustic wave based on the flow rate of the fluid mixture.

9. The method of claim 1, further comprising modifying an amplitude of the standing acoustic wave based on the flow rate of the fluid mixture and a ratio of the first fluid to the second fluid.

10. The method of claim 1, further comprising forming a heterogeneous mixture of the first fluid and the second fluid.

11. The method of claim 1, wherein each pressure node is separated from an adjacent pressure anti-node by ¼ of the wavelength of the standing acoustic wave.

12. A downhole system to separate fluids of a multi-phase mixture, comprising:

a sensor disposed around a conveyance and configured to measure a flow rate of a mixture of droplets of a first fluid having volumes within a first threshold volume, and a second fluid in a second phase that flows through an inner diameter of the conveyance;

a first acoustic device and a second acoustic device positioned around the conveyance and configured to generate a standing acoustic wave through the conveyance to combine a first plurality of the droplets of the first fluid into a second plurality of the droplets having volumes within a second threshold volume that is greater than the first threshold volume; and an acoustic amplifier that is positioned around the exterior surface of the conveyance and configured to amplify the standing acoustic wave through the conveyance.

13. The downhole system of claim 12, further comprising a third acoustic device and a fourth acoustic device positioned around the conveyance uphole from the first acoustic device and the second acoustic device, and configured to generate a second standing acoustic wave through the conveyance to combine the second plurality of droplets into a third plurality of droplets having volumes within a third threshold volume that is greater than the second threshold volume.

14. The downhole system of claim 13, wherein the standing acoustic wave has a first number of nodes and a second number of antinodes, and wherein the second standing acoustic wave has a third number of nodes that is less than the first number of nodes and a fourth number of antinodes that is less than the second number of antinodes.

15. The downhole system of claim 14, wherein the second standing acoustic wave has a longer wavelength than a wavelength of the standing acoustic wave.

16. The downhole system of claim 13, further comprising a fifth acoustic device and a sixth acoustic device positioned around the conveyance uphole from the third acoustic device and the fourth acoustic device, and configured to generate a third standing acoustic wave through the conveyance to combine the third plurality of droplets into a fourth plurality of droplets having volumes within a fourth threshold volume that is greater than the third threshold volume.

17. The downhole system of claim 13, wherein the second standing acoustic wave has a first number of nodes and a second number of antinodes, and wherein the third standing acoustic wave has a third number of nodes that is less than the first number of nodes and a fourth number of antinodes that is less than the second number of antinodes.

18. The downhole system of claim 13, wherein the acoustic amplifier is configured to modify an amplification of the standing acoustic wave within a range of amplifications based on the flow rate of the mixture.

19. The downhole system of claim 13, wherein the sensor is mounted in the inner diameter of the conveyance.

20. The downhole system of claim 12, wherein the second fluid is a carrier fluid and the first fluid is more dense than the second fluid.

* * * * *